US006913816B2

(12) United States Patent
Longcor, IV et al.

(10) Patent No.: US 6,913,816 B2
(45) Date of Patent: Jul. 5, 2005

(54) COMPOSITE MAT PRODUCT FOR ROOFING CONSTRUCTION

(75) Inventors: William K. Longcor, IV, Stillwater, NJ (US); Charles J. Horner, Jr., South Bound Brook, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 261 days.

(21) Appl. No.: 09/969,245

(22) Filed: Oct. 2, 2001

(65) Prior Publication Data

US 2003/0061768 A1 Apr. 3, 2003

(51) Int. Cl.[7] ..... B32B 3/26

(52) U.S. Cl. ..... 428/316.6; 428/311.11; 442/64; 52/95

(58) Field of Search ..... 52/101, 177, 181, 52/180, 408, 199, 95; 454/365, 260; 428/131, 318.4, 311.51, 315.9, 316.6, 311.11, 317.9; 442/64, 76

(56) References Cited

U.S. PATENT DOCUMENTS

| | | | | | |
|---|---|---|---|---|---|
| 3,607,341 | A | * | 9/1971 | Goins et al. | 442/374 |
| 4,283,456 | A | * | 8/1981 | Creasy | 442/326 |
| 4,336,300 | A | * | 6/1982 | Lorant et al. | 428/316.6 |
| 4,359,546 | A | * | 11/1982 | Bershas | 524/501 |
| 4,457,785 | A | * | 7/1984 | Hsu et al. | 106/308 N |
| 4,668,315 | A | * | 5/1987 | Brady et al. | 156/71 |
| 4,681,798 | A | * | 7/1987 | Gill et al. | 428/215 |
| 4,731,399 | A | * | 3/1988 | Fitzgerald et al. | 524/60 |
| 4,775,580 | A | * | 10/1988 | Dighton | 428/284 |
| 4,780,350 | A | * | 10/1988 | O'Connor et al. | 428/109 |
| 4,839,222 | A | * | 6/1989 | Jain | 442/375 |
| 4,876,950 | A | * | 10/1989 | Rudeen | 98/42.21 |
| 5,001,005 | A | * | 3/1991 | Blanpied | 442/373 |
| 5,099,627 | A | * | 3/1992 | Coulton et al. | 52/408 |
| 5,167,579 | A | * | 12/1992 | Rotter | 454/365 |
| 5,238,450 | A | * | 8/1993 | Rotter | 454/260 |
| 5,352,154 | A | * | 10/1994 | Rotter et al. | 454/365 |
| 5,422,055 | A | * | 6/1995 | Yalvac et al. | 264/86 |
| 5,484,653 | A | * | 1/1996 | Kennedy et al. | 442/415 |
| 5,641,584 | A | * | 6/1997 | Andersen et al. | 428/703 |
| 5,676,597 | A | * | 10/1997 | Bettoli et al. | 454/365 |
| 5,683,780 | A | * | 11/1997 | Rodger et al. | 428/95 |
| 5,753,568 | A | * | 5/1998 | Shimano et al. | 442/64 |
| 6,131,353 | A | * | 10/2000 | Egan | 52/408 |
| 6,167,668 | B1 | * | 1/2001 | Fine et al. | 52/403.1 |
| 2002/0061379 | A1 | * | 5/2002 | Zickell et al. | 428/40.1 |

FOREIGN PATENT DOCUMENTS

| | | | | |
|---|---|---|---|---|
| GB | 2066220 | * | 5/1979 | 408/290 |
| GB | 2186898 | * | 8/1987 | 52/408 |
| JP | 309840 | * | 12/1989 | 442/76 |
| JP | 64855 | * | 3/1993 | 442/76 |

* cited by examiner

*Primary Examiner*—Lanna Mai
*Assistant Examiner*—Phi Dieu Tran A
(74) *Attorney, Agent, or Firm*—William J. Davis; Walter Katz

(57) ABSTRACT

This invention relates to a low fiber, pliable composite mat product suitable for use in the construction industry, particularly as an interlayer in roofing between a weathering course, e.g. a shingle and structural decking, e.g. plywood, which is a dry preformed fiber mat containing a binder for the fibers, preferably a preformed glass mat, surfaced or coated on both sides with a prefoamed composition which contains a cured polymer latex, and, preferably, a foam sustaining amount of a surfactant and a flame retarding and/or strengthening amount of a mineral filler, and also to the use and process for the preparation of the above.

2 Claims, 1 Drawing Sheet

COMPOSITE MAT PRODUCT FOR ROOFING CONSTRUCTION

CROSS-REFERENCE TO RELATED U.S. PATENT APPLICATIONS

Figure 1:
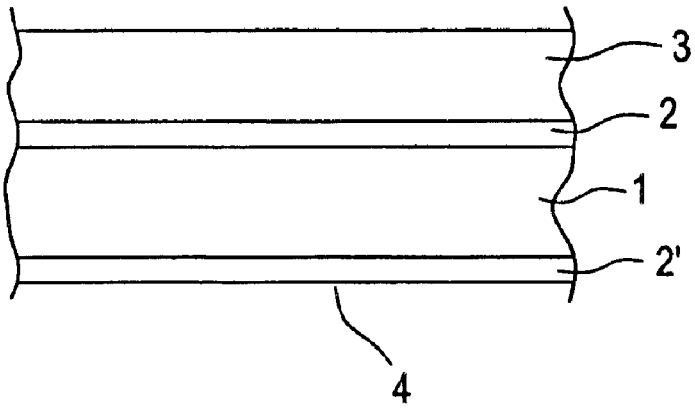

This application is related to U.S. patent applications, Ser. No. 09/376,247, filed Aug. 18, 1999 now U.S. Pat. No. 6,388,991, issued Apr. 9, 2002 and U.S. Ser. No. 09/376,275, filed Aug. 18, 1999 now U.S. Pat. No. 6,365,533, issued Apr. 2, 2002, and Ser. No. 10/117,912, filed Apr. 8, 2002, and assigned to the same assignee as herein.

BACKGROUND OF THE INVENTION

Tar paper felts have been used for many years in making commercial and residential roofs as the interlayer between shingle and plywood. However, such felts are not especially water-resistant which is disadvantageous when the roof is subjected to heavy rain. More particularly, paper felts absorb water easily which cause the felts to buckle appreciably thus affecting the integrity of the shingle.

Accordingly it is an object of this invention to overcome the above-mentioned disadvantages and deficiencies and to provide an advantageous composite mat product and roofing article which can be economically produced by a commercially feasible process.

It is also a particular object herein to provide a mechanically stable, composite mat product suitable for roofing manufacture which will not wrinkle, is breathable to air and water vapor, resists cold temperature delamination, and, particularly, which provides roofing construction which is water-resistant.

These and other objects and advantages of the invention will become apparent from the following description and disclosure.

SUMMARY OF THE INVENTION

The non-asphaltic, non-cellulosic composite mat product for roofing construction of the present invention includes a dry, preformed fibrous glass mat substrate on which is coated, on both sides, with a pre-frothed or pre-foamed composition containing a natural or synthetic latex polymer, and, preferably, a surfactant and an inorganic mineral filler. The composition may optionally contain up to about 15 wt. % of extraneous additives, which include a flame retardant, dye, thickener, porosity reducing agent, thermal and/or UV stabilizers and the like, to provide a foamed felt product having, on a dry weight basis, less than 50% fiber in the mat. The preferred composite mat product contains 30 to 46 wt. % of fiber in the composition consisting of mat fiber with binder and latex in the coating mixture.

IN THE DRAWING

FIG. 1 is a schematic illustration of a composite roofing article according to the present invention.

DETAILED DESCRIPTION OF THE INVENTION

The fibers of the mat employed in this invention include any of the non-cellulosic types, such as fibers of glass, polyester, polypropylene, polyester/polyethylene/teraphthalate copolymers, hybrid types such as polyethylene/glass fibers and other conventional non-cellulosic fibers.

The fibrous mats of the invention, generally of between about 10 and about 30 mils thickness, conventionally contain a binder which is incorporated during mat formation to fix the fibers in a self-sustaining solid web and to prevent loss of fibers during subsequent processing and handling. Such binders include phenol-, melamine- and/or urea-formaldehyde resins or mixtures thereof. Most preferred are the mats having glass fibers in the range of from about 3 to about 20 microns, most desirably 10–18 microns, in diameter and a length of from about 0.25 to about 1.75 inch, most desirably a length of 0.75–1.5 inch.

In this invention, the foamed coating composition which is applied to the preformed mat suitably contains, on a dry weight basis, between about 15 and about 80 wt. % of the thixotropic polymer latex, preferably between 0.01 and about 80 wt. % filler, preferably between about 0.5 and about 10 wt. % foam supporting surfactant, and 0 to 15 wt. % extraneous additives.

The fillers useful in the present coating mixture may include conventional inorganic types such as clays, mica, talc, limestone, kaolin, other stone dusts, gypsum, aluminum silicate (e.g. Kaoplate C), flame retardant aluminum trihydrate, ammonium sulfamate, antimony oxide, calcium silicate, calcium sulfate, and mixtures thereof.

Surfactants which may be employed in the coating composition generally are organic types suitable for stabilizing lattices, such as for example, ammonium or sodium salts of a $C_{10}$ to $C_{22}$ fatty acid, or sulfo-substituted $C_{10}$ to $C_{22}$ fatty acid ester, e.g. ammonium stearate (STANFAX® products). One or more surfactants can be employed in the coating composition to promote the formation of foam and to maintain the foam structure of the coating before curing.

The latex component of the coating composition includes latex polymers of natural rubber as well as synthetic lattices including copolymers of styrene and butadiene and acrylic based resins. Representative examples of these are polyvinyl chloride, styrene/acrylic or methacrylic esters, ethylene/vinyl chloride and polyurethane, polyisoprene, polyvinylidene chloride, polyvinyl acetate/polyvinyl chloride and synthetic rubbers such as SBS, SBR, neoprene, etc. and any other thixotropic latex polymer and mixtures of the foregoing.

The mat coating mixture is obtained from a frothed or foamed 15–80 wt. % aqueous emulsion, dispersion or suspension, which is prefoamed by incorporating air in the aqueous liquid mixture, e.g. by blowing or mixing, with vigorous agitation in the presence or absence of a conventional blowing agent. The resulting frothed or foamed, aerated composition is then coated to a thickness of from about 2 to about 100 mils on the preformed mat surface under ambient conditions using a knife blade, a roller or any other convenient method of application. In one aspect, the foam coated mat is then dried at below its cure temperature to provide a foamed, self-supporting product having a reduced coating thickness of up to 90 mils which adheres to both surfaces of the mat surface. In another aspect, the foamed coated mat is dried and cured simultaneously.

The resulting mat product of this invention is desirably flexible and will not wrinkle during use.

As indicated above, the foamed coating of the present facer can be formed in the absence or presence of a blowing agent to provide a composition of reduced density, which density can be reduced from above about 2 g/cc to as little as 0.15 g/cc. Advantageously, the consistency of the foam is such that the coating mixture does not penetrate through the mat and ideally simulates the consistency of shaving cream.

Generally the amount of air incorporated into the foamable mixture prior to coating is between about 5% and about 80% by volume for optimal consistency and the resulting foamed mixture has bubble openings sufficiently small so as to inhibit liquid bleed through the mat.

Applying a film or laminating a layer of impervious resin or polymer over the foamed surface to provide a tri-layered facer member can provide a totally liquid impervious surface on the facer, in special cases where such is desired. A top seal coat of a non-foamed latex is suitable for this purpose. Alternatively, a thermoplastic such as polyethylene powder or unexpanded polystyrene beads can be used as a filler which melts at the drying/curing temperatures to close substantially all pores of the pervious coating. Expandable excipients and additives such as cellulose can also be used for this purpose; although the use of a seal coat is neither needed nor recommended. Other methods for accomplishing the similar purpose include the use of less air during foaming, the omission or use of less inorganic filler in the coating composition, calendering and/or embossing the foamed or frothed surface by contact with a hot roller or platen. Still another method for producing the totally impervious surface involves forming the foam on the smooth surface of a conventional release material and then contacting the mat with the opposite surface of the foam. A combination of any of the above options can be employed for specialized purposes if desired.

The present latex coating composition may additionally contain a minor amount, up to 15%, preferably less than about 3 wt. %, of a conventional thickening agent, for example an acrylic polymer thickener, e.g. (ACRYSOL ASE 95NP and/or 60NP, or Parugum 500 or 511) and the like. Other inert excipients such as a UV or thermal stabilizer, a conventional coloring agent, texturizing agent, reinforcing or crosslinking agent, (e.g. Aerotek M-3 resin) and/or blowing agent may also be included in the coating mixture; although addition of these additives in a minor amount of less than 2 wt. % are preferred.

Roofing construction according to the present invention, as shown in FIG. 1, is made by interlaying the composite of the glass fiber mat 1 coated on both sides 2 and 2' with the cured latex foam composition, e.g. by dipping, or spraying, or other suitable means, between a weathering course 3, e.g. a shingle, and structural decking 4, e.g. plywood, during the construction of residential and commercial roofing. The composite roofing article is permeable to air so that water vapor can escape easily through the mat and coatings. Accordingly, it is observed that the composite does not buckle in use even after heavy rainfall on the roof.

While the invention has been described with particular reference to certain embodiments thereof, it will be understood that changes and modifications may be made which are within the skill of the art. Accordingly, it is intended to be bound only by the following claims, in which:

What is claimed is:

1. Water-resistant roofing construction comprising a non-asphaltic, non-cellulosic, flexible, air and water-vapor-permeable composite mat product comprising (a) a glass mat of glass fibers of about 3 to about 20 microns in diameter and of about 0.25 to 1.75 inch in length, and a mat thickness of about 10 to about 30 mils, surfaced or coated on both sides with (b) a cured natural or synthetic thixotropic polymer latex foam coating, wherein the cured natural natural or synthetic thixotropic polymer latex foam coating comprises between 15 and about 80 wt. % of a foamed mixture containing, on a dry weight basis, between about 15 and about 80 wt. % of said polymer latex, between about 0.01 and about 80 wt. % of a mineral filler, and between about 0.5 and about 10 wt. % of a foam supporting surfactant, the density of the foam coating being about 0.15 to 2 g/cc, wherein the consistency of said foam assures that it does not penetrate through the mat, and the amount of air incorporated into the foamable mixture prior to coating is between about 5 and about 80% by volume, and the resulting foamed mixture has bubble openings sufficiently small so as to inhibit liquid bleed through the mat, inter-layered between a weathering course and structural decking, which is permeable to both air and water vapor so that both can escape through the mat and its coatings.

2. Water-resistant roofing construction according to claim 1 wherein the weathering course is a shingle and the structural decking is plywood.

* * * * *